US008252144B2

(12) United States Patent
Steif

(10) Patent No.: US 8,252,144 B2
(45) Date of Patent: Aug. 28, 2012

(54) FLAME RESISTANT PAPER PRODUCT AND METHOD FOR MANUFACTURING

(75) Inventor: Robert Steif, Wausau, WI (US)

(73) Assignee: Wausau Paper Mills, LLC, Mosinee, WI (US)

( * ) Notice: Subject to any disclaimer, the term of this patent is extended or adjusted under 35 U.S.C. 154(b) by 1354 days.

(21) Appl. No.: 10/856,416

(22) Filed: May 27, 2004

(65) Prior Publication Data

US 2005/0274472 A1 Dec. 15, 2005

(51) Int. Cl.
*D21H 17/63* (2006.01)
*D21H 21/14* (2006.01)

(52) U.S. Cl. ..... 162/181.3; 162/158; 162/159; 162/184; 162/204; 106/18.11; 106/18.14; 106/18.16; 106/18.31; 106/18.33; 428/921; 252/607

(58) Field of Classification Search ..... 162/158, 162/159, 181.3, 184, 204; 106/18.11, 18.14, 106/18.16, 18.31, 18.33; 428/921; 252/607
See application file for complete search history.

(56) References Cited

U.S. PATENT DOCUMENTS

| | | | | | |
|---|---|---|---|---|---|
| 2,349,704 | A | * | 5/1944 | Clark | 162/231 |
| 3,288,632 | A | * | 11/1966 | Rush et al. | 427/211 |
| 3,650,820 | A | * | 3/1972 | DiPietro et al. | 427/391 |
| 3,982,056 | A | * | 9/1976 | Holder, Jr. | 427/361 |
| 4,139,410 | A | | 2/1979 | Tapio et al. | |
| 4,212,675 | A | * | 7/1980 | Robinson | 106/18.15 |
| 4,419,401 | A | * | 12/1983 | Pearson | 442/142 |
| 4,487,657 | A | | 12/1984 | Gomez | |
| 4,746,403 | A | * | 5/1988 | Ko et al. | 162/108 |
| 5,151,225 | A | * | 9/1992 | Herndon et al. | 252/607 |
| 5,958,117 | A | * | 9/1999 | Crouch et al. | 106/18.11 |
| 6,153,544 | A | * | 11/2000 | Radwanski et al. | 442/153 |
| 6,194,477 | B1 | | 2/2001 | Cawse et al. | |
| 6,303,234 | B1 | | 10/2001 | Slimak et al. | |
| 6,322,853 | B1 | | 11/2001 | B. | |
| 2003/0051840 | A1 | * | 3/2003 | Ochi et al. | 162/158 |
| 2004/0123966 | A1 | * | 7/2004 | Altman et al. | 162/205 |

FOREIGN PATENT DOCUMENTS

WO WO 03/078731 A2 * 9/2003

* cited by examiner

*Primary Examiner* — Matthew Daniels
*Assistant Examiner* — Dennis Cordray
(74) *Attorney, Agent, or Firm* — Merchant & Gould, P.C.

(57) ABSTRACT

The invention relates to a flame resistant paper product and a method for manufacturing a flame resistant paper product. In an embodiment the invention is a paper product comprising a paper substrate having a first surface and a second surface and a flame retardant composition, wherein the first surface is smoother than the second surface. In another embodiment, the invention is a method for forming a flame resistant paper product comprising applying a flame retardant composition to a web of fibers having a first surface and a second surface, wherein the first surface is smoother than the second surface by at least about 70 SSU according to TAPPI T538.

40 Claims, 2 Drawing Sheets

FLAME RESISTANT PAPER PRODUCT AND METHOD FOR MANUFACTURING

FIELD OF THE INVENTION

The invention relates to a flame resistant paper product and a method for manufacturing a flame resistant paper product. In particular, the paper product can be characterized as "machine-glazed" and exhibits flame resistant properties.

BACKGROUND OF THE INVENTION

Paper products are commonly used as a substrate onto which inks, pigments, or colors are applied in the course of printing, hobbies, or art projects. One type of paper product is known as machine glazed (MG) and refers to paper having a first side with a glazed surface and a second side having a texture that is rougher than the first side. Machine glazed paper products can provide a smoother surface which is suitable for finger painting, felt markers, and the like, while also providing a rougher surface that is suitable for water color painting, tempra, and chalk.

Some inks, pigments, or colors are applied with an organic solvent carrier. Some solvents are flammable and may create fire hazards. Even if the solvents used don't contribute to fire danger, the presence of quantities of dry paper may itself pose a fire hazard that may be unacceptable in many environments.

Paper products are available that have been made with a flame resistant treatment. For example, see U.S. Pat. No. 6,322,853 (B. et al.) and U.S. Pat. No. 6,303,234 (Slimak et al.).

SUMMARY OF THE INVENTION

Figure 1:
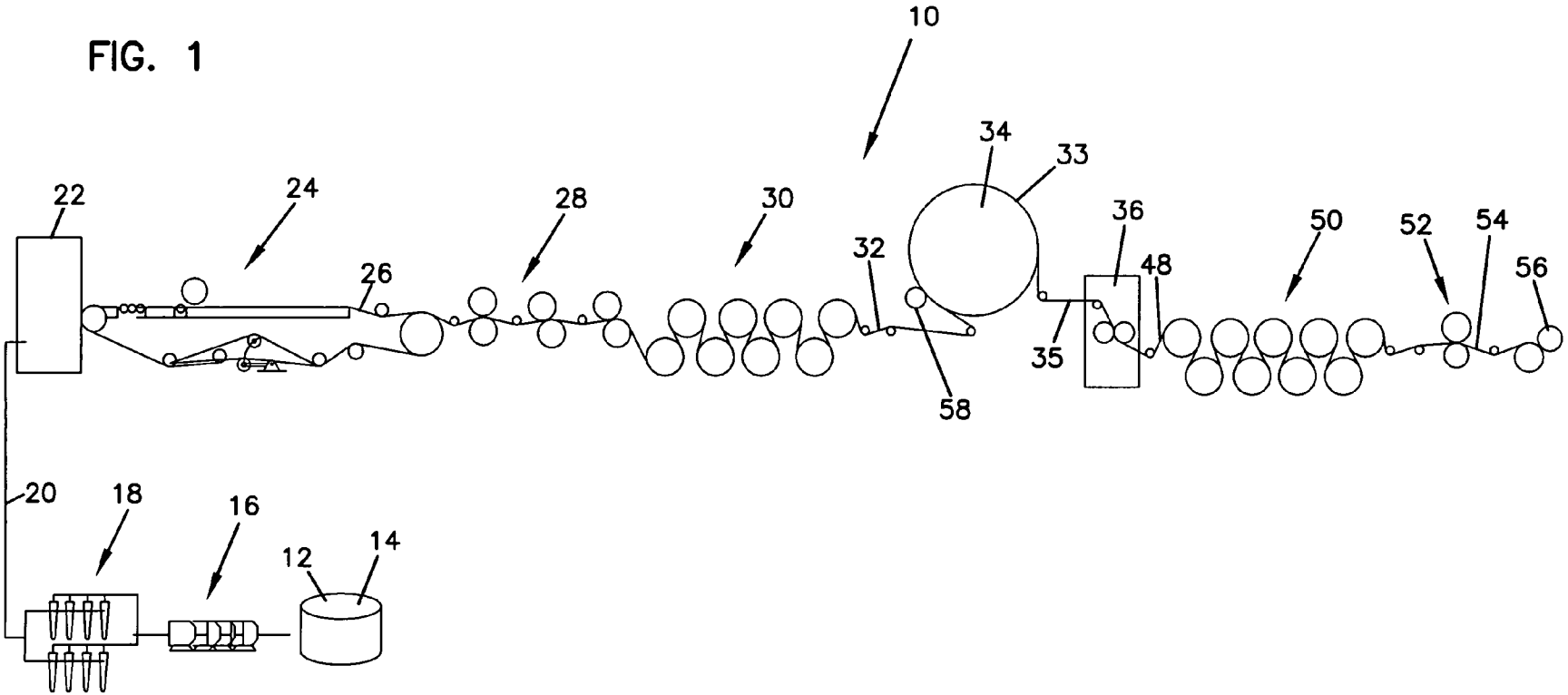
FIG. 1 is a schematic view of an exemplary process for manufacturing a paper substrate according to the invention.

In an embodiment the invention is a paper product comprising a paper substrate having a web of fibers and a flame retardant composition, wherein the paper substrate has a first surface and a second surface having a differential smoothness and the paper substrate has a flame resistance allowing a char length of less than 4.5 inches according to TAPPI T461. In another embodiment, the invention is a method for forming a flame resistant paper product comprising applying a flame retardant composition to a web of fibers having a first surface and a second surface, wherein the first surface is smoother than the second surface by at least about 70 SSU according to TAPPI T538. The paper product can be manufactured in any color desired.

DETAILED DESCRIPTION

The term "machine glazed paper" or MG paper refers to paper having a first side with a glazed surface and a second side having a texture that is rougher than the first side. Such paper has many applications for hobbyists and in educational settings. The smoother surface can be used for finger painting, felt markers, and the like. In contrast, the rougher surface is suitable for water color painting, tempra, chalk, and the like. However, application of a flame retardant composition to machine glazed paper can reduce the smoothness of the highly glazed surface, which is undesirable.

As used herein, the term "single-ply paper product(s)" refers to paper products that are formed from a single web of fibers without another web of fibers being laminated thereto. The term "dual-finish paper product(s)" refers to paper products wherein both sides have characteristics of a finish in comparison with completely unfinished paper. The term "differential smoothness" refers to the situation wherein one side of a paper product has a smoothness that is different from the other side to a degree sufficient so as to impart different characteristics to each side. The term "differential gloss" refers to the situation wherein one side of a paper product has a gloss that is different from the other side to a degree sufficient so as to impart different characteristics to each side.

In an embodiment of the invention, a single-ply flame resistant paper product having a smooth side and a rough side is provided, wherein the difference in smoothness between the two sides is preserved after application of a flame retardant composition. In an embodiment the invention is a paper product comprising a paper substrate having a first surface and a second surface and a flame retardant composition, wherein the first surface is smoother than the second surface. The paper product can be manufactured in any color desired.

In an embodiment of the invention, a method is provided for forming a flame resistant paper product comprising applying a flame retardant composition to a web of fibers having a first surface and a second surface, wherein the first surface is smoother than the second surface by at least about 70 SSU (Sheffield Smoothness Units) according to TAPPI T538. In another embodiment, the invention is a method for forming a flame resistant paper product comprising forming a web of fibers having a first side and a second side, drying the web of fibers to a desired moisture content, contacting the first side of the web of fibers against a Yankee cylinder, smoothing the surface of the first side with the Yankee cylinder, thereby making the first side smoother than the second side, applying a flame retardant composition only to the second side of the web of fibers, and drying the web of fibers to a second desired moisture content.

Manufacture of the Flame Resistant Paper Product

Referring to FIG. 1, a process for making a paper product according to the invention is shown at reference numeral 10. It should be understood that schematic diagram 10 is an exemplary schematic diagram and includes many of the operations carried out in commercial paper making facilities. The equipment used in a particular operation may vary from facility to facility, but it is expected that the same general operations will be present.

The starting material 12 generally includes wood pulp 14. The wood pulp can include a blend of hard wood and soft wood fibers. The wood pulp can be provided as cellulose fiber from chemical pulped wood, and can include a blend from coniferous and deciduous trees. Blends of hardwood and softwood fibers are frequently used. The fibers can also be bleached or unbleached. One of skill in the art will appreciate that the bleaching can be accomplished through many methods including the use of chlorine, hypochlorite, chlorine dioxide, oxygen, peroxide, ozone, or a caustic extraction. The fibers may also comprise other types of natural fibers or synthetic fibers as described more fully below. The starting material 12 may also include post-consumer waster fiber. Post-consumer waste fiber is recovered from paper that is recycled after consumer use. By way of example, the starting material 12 may include at least 10% post-consumer waster fiber or at least 30% post-consumer waster fiber. The starting material 12 may include fibers from various sources as described in greater detail below. The starting material 12 can be processed through a refining operation 16 and through a cleaning operation 18. The cleansed pulp 20 is then applied through a head box 22 onto a fourdrinier machine 24 to provide a web of fibers 26. The side of the web of fibers 26 facing down on the fourdrinier machine 24 is known as the "wire side." The side of the web of fibers 26 facing up on the fourdrinier machine 24 is known as the "felt side." Certain additives can be added prior to the head box 22 and this is referred to as "wet end chemistry."

Wet end additives can be provided for strength, opacity, coloring (dyes), etc. Exemplary wet strength additives include urea-formaldehyde, melamine-formaldehyde, and polyamide. Exemplary dry strength additives include starches (such as cationic potato starch). However, one of skill in the art will appreciate that many different types of starches can be used such as corn starch, rice starch, tapioca starch, and wheat starch. Exemplary opacifying additives include kaolin clays, titanium dioxide, and calcium carbonate. It should be understood that through the use of dyes, a paper product of any color desired can be made. One of skill in the art will appreciate that these components may be added in many different manners including being added as a part of a batch control process or being added through a metering system for continuous operations. Other components, such as defoaming agents, pitch dispersants, plasticizers (urea), etc. may also be added prior to the head box 22. Acid alum (aluminum sulfate and sulfuric acid) may be added prior to the head box 22. Acid alum can serve various purposes including drainage enhancement, rosin sizing, part of certain retention aid programs, dye fixation, cationic source, acidic buffer. Sizing agents that increase water hold-out are sometimes added as a part of wet end chemistry. However, sizing agents added during wet end chemistry may reduce penetration of agents added later on in the paper making process, such as flame retardant agents. Therefore, components are added at the size press only in proportions allowing sufficient penetration of agents added later on in the paper making process. In an embodiment, no sizing agents are added as a part of wet end chemistry. In an embodiment, only acid alum, cationic potato starch, and coloring are added prior to the head box 22 as a part of wet end chemistry.

The web of fibers 26 can be considered continuous in the machine direction. The web of fibers 26 can be processed through a wet press section 28 to remove water, and then through a first drier section 30 to further reduce the water content and provide an intermediate paper substrate 32. If the water content is too low, the intermediate paper substrate 32 may not be able to be processed properly in further manufacturing steps. For example, the intermediate paper substrate 32 may not adhere properly to a Yankee cylinder 34 as described below. In an embodiment, the intermediate paper substrate 32 has a water content of greater than about 38.0 wt. %. If the water content is too high, the intermediate paper substrate 32 may be difficult to process. In an embodiment, the intermediate paper substrate has a water content of less than about 58.0 wt. %. In an embodiment, the intermediate paper substrate 32 can have a moisture level of between about 42.0 wt. % to about 54.0 wt. %. In a particular embodiment, the intermediate paper substrate 32 can have a moisture level of between 45 wt. % to 48 wt. %.

The intermediate paper substrate 32 can then be processed with a machine 33 to impart machine-glazed properties. An exemplary machine 33 that can be used to impart machine-glazed properties is a Yankee cylinder 34. A Yankee cylinder refers to a drying cylinder that has a smoothness-imparting surface and is configured for longer treatment times than an ordinary drying cylinder. An exemplary Yankee cylinder is described in Tapio et al. (U.S. Pat. No. 4,139,410) the contents of which is herein incorporated by reference. A Yankee cylinder may have a diameter of between 5 and 6 meters. However, Yankee cylinders may also have other diameters. The exterior surface of the Yankee cylinder is polished to be very smooth and is also heated. By way of example, the exterior surface of the Yankee cylinder may be between about 200 and 300 degrees Fahrenheit. The intermediate paper substrate 32 contacts the Yankee cylinder 34 and then tightly adheres to the surface. The degree of adhesion of the intermediate paper substrate 32 to the Yankee cylinder surface depends on the amount of moisture left in the paper after the first drier section 30. Pressure is applied to the intermediate paper substrate 32 through one or more pressure rollers 58. One of skill in the art will appreciate that a felt fabric (not shown) may be used that separates the intermediate paper substrate 32 and the pressure roller 58 from direct contact. The felt fabric can help to control the intermediate paper substrate 32 as it enters the nip between the pressure roller 58 and the Yankee cylinder 34. The felt fabric can also help the pressure roller 58 apply uniform pressure across the width of the intermediate paper substrate 32 and prevent the intermediate paper substrate 32 from sticking to the pressure roller 58. As the web is adhered to the hot surface of the Yankee cylinder 34, it continually dries and travels a distance of between 10 and 15 meters without being loosened from the cylinder surface. This process results in a machine-glazed paper substrate 35 wherein the paper surface that has contacted the cylinder surface is smoother and has a higher gloss than the surface that travels around the cylinder facing outwards. In the embodiment shown, the smoother side is the wire side of the machine-glazed paper substrate 35. However, the configuration of the Yankee cylinder could be changed so that the felt side of the machine glazed paper substrate 35 becomes the smooth side. Alternatively, the smoothness differential between the two sides of the paper substrate could be achieved through other processes. For example, the smoothness differential could be achieved by calendaring with rolls of differential hardness or differential surface finish.

The machine glazed paper substrate 35 is then processed through a size press 36. Certain additives can be added to the size press composition and this is referred to as "size press chemistry." Size press additives can be provided for water resistance, strength, and for flame resistance. Exemplary water resistance additives include rosin and alkylketene dimer (AKD). Exemplary flame retardant agents include ammonium sulfate, monoammonium phosphate, and diammonium phosphate. Other flame retardant agents are described below. Other components, such as plasticizers, can also be added at the size press. An exemplary plasticizer is urea. The size press composition can comprise a flame retardant agent, a sizing agent, and a plasticizer. An exemplary size press composition comprises ammonium sulfate, monoammonium phosphate, urea, and alkyl ketene dimer (AKD). The size press composition can contain from about 3.6 wt. % to about 4.4 wt. % urea; from about 19.5 wt. % to about 23.5 wt. % ammonium sulfate; from about 4.9 wt. % to about 5.9 wt. % monoammonium phosphate; and from about 0.8 wt. % to about 1.0 wt. % HERCON 70™ (an alkyl ketene dimer).

An exemplary size press composition may be made by heating 0.75 gallons of water to 120 degrees Fahrenheit and adding 0.383 pounds of urea, 2.067 pounds of ammonium sulfate, 0.516 pounds of monoammonium phosphate, and 0.660 pounds of HERCON 70™ (an alkyl ketene dimer) and then adding a further amount of water to bring the solution to a total volume of 1 gallon. This formula results in a size press composition containing about 4.0 wt. % urea; about 21.6 wt. % ammonium sulfate; about 5.4 wt. % monoammonium phosphate; and about 0.9 wt. % HERCON 70™ (an alkyl ketene dimer) (these weight percentages referring to the size press composition are calculated based on the assumption that the composition will have a density of about 9.57 pounds per gallon). These proportions are scalable to produce total volumes of any desired amount.

In an embodiment, the size press composition comprises ammonium sulfate, monoammonium phosphate, urea, and alkyl ketene dimer (AKD) in amounts so as to result in 13.1 wt. % ammonium sulfate, 5.8 wt. % monoammonium phosphate, 2.4 wt. % urea, and 0.75 wt. % alkyl ketene dimer (AKD) in the finished paper product.

Figure 2:
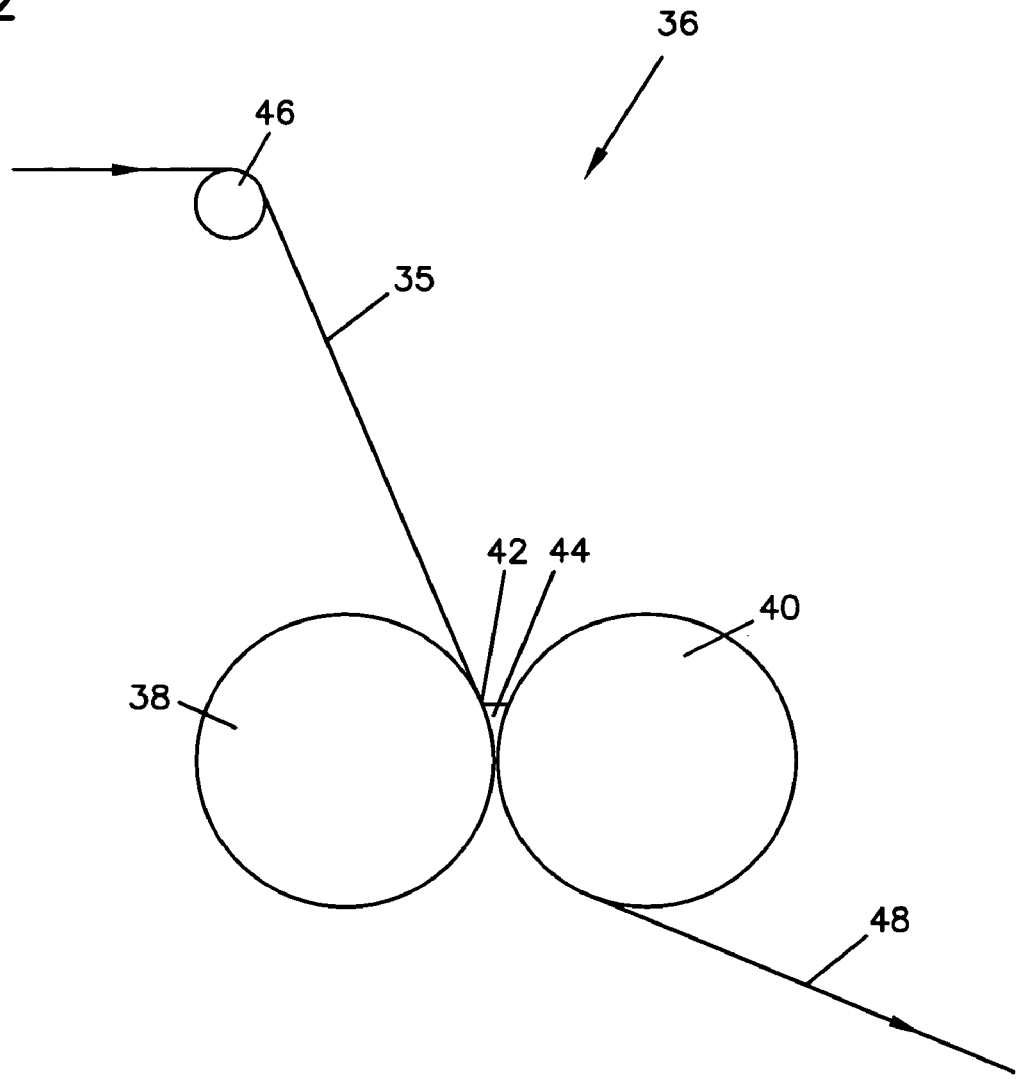
FIG. 2 is a schematic view of a size press operation of an exemplary process for manufacturing a paper substrate according to the invention.

Referring now to FIG. 2, a schematic view of the size press is shown. The components to be added at the size press are mixed into a composition and put into the size press composition pond 44. The machine glazed paper substrate 35 passes over a positional roller 46 and contacts a first size press roller 38 at a point 42 that is above the size press composition pond 44. The machine glazed paper substrate 35 moves through the size press composition pond 44 as it passes through the size press 36. However, because the smooth side of the paper is against a first size press roller 38, only the rougher side of the paper directly contacts the composition in the size press composition pond 44. It is believed that between 20-40 SSU (Sheffield Smoothness Units) would be lost from the smooth side if the size press composition were to directly contact the smooth side. It is also believed that the composition then permeates the web of fibers through a wicking action. The total amount of composition added to the web of fibers can be manipulated in various ways. For example, the amount of composition taken up by the web of fibers tends to increase with increasing moisture concentration of the web of fibers. Therefore, to increase the amount of composition added to the web of fibers, the amount of moisture in the web of fibers, as it comes off the Yankee cylinder, is increased. Because it is desirable to have the composition permeate the web of fibers, water resistance agents, such as alkylketene dimer (AKD) are generally incorporated into the size press composition instead of added before the head box 22 as a part of wet-end chemistry.

There are also other means of applying components besides applying them at the size press 36. Other application technologies including roll coaters, gate-roll coaters, blade coaters, metering size presses, bill blade coater, and sprayers may also be used to apply components to the machine glazed paper substrate 35 as a part of the paper making machine ("on machine") or as a part of a procedure entirely separate from the paper making machine ("off machine"). By way of example, otherwise finished paper may be unrolled and then fed through a separate machine to apply a specific component.

The machine glazed paper substrate 35 then passes in between the first size press roller 38 and the second size press roller 40. Referring now to FIG. 1, the treated paper substrate 48 is then dried in a second drier section 50 and calendered in a machine calender 52 to provide a finished paper substrate 54. The paper may be unsuitable for some end uses if the moisture content is too high. In an embodiment, the second drier section 50 reduces moisture content of the paper product to less than about 12.0%. It may be economically inefficient to reduce the moisture content too low. In an embodiment, the second drier section 50 reduces moisture content of the paper product to greater than about 1.0%. In an embodiment, the second drier section 50 reduces moisture content of the paper product to a range of about 2.0 wt. % to about 8.0 wt. %. In a particular embodiment, the moisture content of the paper product is about 3.0 wt. % to about 4.0 wt. %. The finished paper substrate 54 can then be wound onto a reel 56. The reel 56 can then be sent to a winder (not shown) for conversion into smaller rolls that may be referred to as roll-stock. The roll stock may then be subjected to subsequent converting processes (not shown) wherein the roll stock is made into end use rolls of various sizes or sheets of various sizes. End use rolls may vary in size depending on the intended use. By way of example, end use rolls may be produced in the dimensions of 3 feet by about 30 feet in length. End use rolls may also be produced in the dimensions of 3 feet by about 1000 feet in length. End use rolls may also be produced in the dimensions of 1 foot by about 48 feet in length. The roll stock may also be cut into sheets for certain applications.

One of skill in the art will appreciate that the finished paper product has many applications including use as a paper substrate for art projects, educational projects, and hobbies.

Paper Substrate

The finished paper substrate refers to the web of fibers and additives from both wet end chemistry and size press chemistry. In general, any weight of paper may be used in accordance with the present invention. Therefore, the finished paper substrate is made in weights desired by end users. However, using a paper substrate that is heavier than necessary for a particular application may be economically inefficient. In an embodiment, the finished paper substrate is less than about 200 pounds per 3000 $ft^2$ of paper. Paper machines may have difficulty handling paper that is low in weight. In an embodiment, the finished paper substrate is greater than about 12 pounds per 3000 $ft^2$ of paper. The finished paper substrate of the invention may also be in the range of 40 to 54 pounds per 3000 $ft^2$ of paper. In a particular embodiment, the finished paper substrate is in the range of about 44 to about 50 pounds per 3000 $ft^2$.

The porosity of a paper substrate can be measured through several means. One type of testing for porosity is to determine the air permeability of a sample piece of paper. One way to accomplish this is through the use of a GURLEY™ densometer. By way of example, a GURLEY™ model 4110N densometer (Thwing-Albert, Philadelphia, Pa.) can be used to determine the air permeability of a sample piece of paper. A standard for this mode of testing is TAPPI (Technical Association of the Pulp and Paper Industry) standard test T 460.

A paper substrate that does not have a desired level of porosity will prevent a flame retardant composition from wicking through the web of fibers. In an embodiment, the paper substrate has a porosity value of less than 1000 sec./100 ml (e.g., a lower number indicates greater porosity). A paper substrate that is too porous will not provide suitable water hold-out for various end use applications. In an embodiment, the paper substrate has a porosity value of greater than 5 sec./100 ml (e.g., a higher number indicates lesser porosity). The paper substrate may have a porosity in the range of about 15 sec./100 ml to about 50 sec./100 ml. In a particular embodiment, the paper substrate may have a porosity of about 25 sec./100 ml to about 40 sec./100 ml.

The pulp used for creating the web of fibers can include a blend of hardwood and softwood fibers. The pulp can be provided as cellulose fiber from chemical pulped wood, and can include a blend from coniferous and deciduous trees. By way of example, the fibers can be from Northern hardwood, Northern softwood, Southern hardwood, or Southern softwood. Hardwood fibers tend to be more brittle but are generally more cost effective for use because the yield for pulp from hardwood is higher than the yield for pulp from softwood. In an embodiment, the pulp contains from about 0 to about 70% hardwood fibers. In another embodiment, the pulp contains from about 10 to about 30% hardwood fibers. In a particular embodiment, the pulp contains about 17% hardwood fibers. Softwood fibers have better paper making characteristics but are more expensive. In an embodiment, the pulp contains from about 0 to about 70% softwood fibers. In another embodiment, the pulp contains from about 30 to about 50% softwood fibers. In a particular embodiment, the pulp contains about 42% softwood fibers. Blends of hardwood and softwood fibers are frequently used.

The pulp can also include post-consumer waste (PCW) fiber. Post-consumer waste fiber is recovered from paper that is recycled after consumer use. Post-consumer waste fiber can include both natural and synthetic fiber. Incorporation of PCW fiber can aid in efficient use of resources and increase the satisfaction of the end user. In an embodiment, the pulp includes at least 10% PCW fiber. In another embodiment, the pulp includes at least 20% PCW fiber. In still another embodiment, the pulp includes at least 30% PCW fiber. PCW fiber may not have the same strength characteristics as virgin cellulose fiber and may be more expensive to incorporate. In an embodiment, the pulp includes at least 10% PCW fiber but less than 50% PCW fiber. In another embodiment, the pulp includes at least 20% PCW fiber but less than 40% PCW fiber.

One of skill in the art will appreciate that the web of fibers can comprise many different types of fibers, both natural and synthetic. Exemplary natural fibers that can be used include wood fibers and non-wood natural fibers such as vegetable fibers, cotton, various straws (wheat, rye, and others), various canes (bagasse and kenaf), grasses (bamboo, etc.), hemp, corn stalks, etc. Exemplary synthetic fibers include polyester, polypropylene, polyethylene, rayon, nylon, acrylic, glass, and the like.

The fibers used in the invention can be extracted with various pulping techniques. For example, mechanical or high yield pulping can be used for stone groundwood, pressurized groundwood, refiner mechanical pulp, and thermomechanical pulp. Chemical pulping can be used incorporating kraft, sulfite, and soda processing. Semi-chemical and chemi-mechanical pulping can also be used which includes combinations of mechanical and chemical processes to produce chemi-thermomechanical pulp.

In some embodiments, the paper substrate should not be too transparent. In order to prevent the paper substrate from being too transparent, various components can be added to make the paper more opaque. As one example, amounts of titanium dioxide can be added to the paper to make the paper substrate more opaque. Other examples of potential additives include kaolin clays and calcium carbonate.

Caliper refers to paper thickness, as determined by measuring the distance between smooth, flat plates at a defined pressure. The caliper of a sheet of a paper substrate may be measured in accordance with TAPPI T411. A paper substrate that is too thick may be too heavy for some uses. In an embodiment, the paper substrate has a caliper of less than about 6.0 mil. A paper substrate that is too thin may be too light for some uses and may be too fragile. In an embodiment, the paper substrate has a caliper of greater than about 2.0 mil. In an embodiment, the paper substrate has a caliper of between about 3.0 mil and about 5.0 mil. In a particular embodiment, the paper substrate has a caliper between about 3.5 mil and about 4.3 mil.

Flame Retardants and Testing

Various flame retardant compositions may be applied to the paper substrate to impart flame resistance properties to the paper substrate. One of skill in the art will appreciate that the ability of a paper product to resist flame can be tested in many ways. For example, a standard procedure for this test is described by TAPPI T461.

An exemplary test method for flame resistance corresponding to TAPPI T461 comprises first cutting six samples (2.75 inches in width by at least 8.25 inches in length), with 1 each from the front, center, and back of a sample sheet or roll in both MD (machine direction) and CD (cross direction) directions. The MD direction is parallel to the direction in which a web of fibers is continuous during operation of a papermaking machine. A greater number of fibers in a sheet of paper tend to be oriented in the MD direction as a result of the forward motion of the wire of the papermaking machine. The CD direction is perpendicular to the MD direction.

The samples are then clamped in a holder with the long axis vertical. A Bunsen burner is lit and adjusted so that the flame is approximately 40 mm. The flame is then placed under a given sample for 12 seconds and then withdrawn. The sample is removed from the holder and the charred area is gently tapped with a 6 mm diameter rod to break away the loose char. The length from the bottom edge of the specimen to the end of the charred void area is then measured (char length) and recorded to the nearest 0.1 inch. The average char length of the three MD samples is then calculated along with the average char length of the three CD samples.

The greater the char length, the less the flame resistance is of a given sample. A paper product without sufficient flame resistance may allow a char length that is too long. For example, untreated paper may ignite and continue to combust after the Bunsen burner is removed such that the char length cannot be measured as the paper is completely burned. In contrast, a finished paper product in accordance with an embodiment of the present invention can resist combustion after the Bunsen burner is removed. In an embodiment, a finished paper product produced in accordance with the invention has a flame resistance allowing a char of less than 5.5 inches according to TAPPI T461 in both the MD and CD directions. A paper product with high flame resistance may be unnecessary for some applications and may therefore be economically inefficient to produce. In an embodiment, a finished paper product produced in accordance with the invention has a flame resistance allowing a char of greater than 1.0 inch according to TAPPI T461 in both the MD and CD directions. In a particular embodiment, a finished paper product produced in accordance with the invention has a flame resistance of between 2.0 and 4.5 inches according to TAPPI T461 in both the MD and CD directions. In an embodiment, execution of TAPPI test T461 causes of char of less than 4.5 inches on a sample of the paper product.

An exemplary test method for consistent flame resistance over the full width of a web of fibers comprises first obtaining a notched sample holder which can be used to keep a strip of paper at a consistent height above a flame, while moving the strip of paper so that the flame contacts the entire width as the paper is moved. A sample is cut to comprise a full web width strip at least 12 inches high. The Bunsen burner flame is adjusted such that the flame tip is just above the lower edge of the notches on the sample holder. Accordingly, the flame tip is at a height just above the bottom of where the strip of paper will be when it is inserted into the notched sample holder. The sample strip is then placed into the notched sample holder and slowly drawn across the flame for the entire width of the sample strip. The test is considered a success so long as there are no areas where the full height of the sample strip is burned.

Various flame retardant agents may be used to achieve desired levels of flame resistance. These flame retardants agents may be used in the form of a composition that is then applied to the paper substrate. The flame retardant composition can be applied at various points in the paper making process. For example the flame retardant composition can be applied as a part of wet end chemistry or at the size press. In an embodiment, a flame retardant composition is applied to the paper substrate at the size press to the less smooth side of the paper substrate.

Exemplary flame retardant agents may include inorganic salts, organic polymers, organic substances, or other components. Exemplary inorganic salts include monoammonium phosphate, diammonium phosphate, ammonium polyphosphate, ammonium sulfate, ammonium borate, borax, boric acid salts, ammonium sulfamates, sulfamic acid salts, aluminum sulfate, or sodium silicates. Exemplary organic polymers and organic substances include intumescent coatings (coatings that form a char foam upon combustion), organic phosphorous containing compounds (e.g., PYROSE™, FYROL™, etc.), organic phosphoramides (including compounds made with urea, dicyandiamide, dicyanoguanidine, or melamine-formaldehyde resin), melamine, melamine borate, pentaerythritol, chlorinated phosphorous compounds (e.g., PHOSGARD™), guanyl urea phosphate, polyvinylchloride emulsions and copolymers, polyvinyldichloride emulsions, polyvinylidene chloride emulsions, ethylene-vinyl chloride, neoprene, chlorinated paraffins, chlorinated naphthalene, chlorendic anhydride, chlorendic diol, or brominated compounds. Other exemplary flame retardant agents include aluminum trihydrate, zinc borate, antimony trioxide, mineral fibers, synthetic flame resistant fibers, zinc phosphates, or zinc fluoroborate. In an embodiment the flame retardant agent may include at least one of ammonium sulfate, monoammonium phosphate, and diammonium phosphate.

The flame retardant compositions of the invention may be used in various concentrations. Many flame retardant agents have an upper limit as to how much can be dissolved into an aqueous solution. Therefore, there is a limit as to how much can be deposited in one application. Moreover, using more than is necessary may be economically inefficient. However, if higher amounts of flame retardant agents are desired, it is possible to use a multi-step application process. On the other hand, if sufficient flame retardant agent is not present, the paper substrate may not achieve the desired amount of flame resistance.

In an embodiment, the flame retardant composition comprises ammonium sulfate and monoammonium phosphate. These flame retardant agents may not provide significant flame resistance if not present in a sufficient amount. Therefore, in an embodiment, the paper product, when dried to a finished level, comprises at least 8 wt. % ammonium sulfate and at least 3 wt. % monoammonium phosphate. As these flame retardant agents are typically applied dissolved in a solvent, there are limits as to how much can be dissolved before they begin to crystallize and fall out of solution. Additionally, using too much of these flame retardant agents is economically inefficient. In an embodiment, the paper product, when dried to a finished level, comprises less than 18 wt. % ammonium sulfate and less than 9 wt. % monoammonium phosphate. In an embodiment, the paper product, when dried to a finished level, comprises from about 12 to about 14 wt. % ammonium sulfate and from about 5 to about 7 wt. % monoammonium phosphate. In a particular embodiment, the paper product, when dried to a finished level, comprises about 13.1 wt. % ammonium sulfate and about 5.8 wt. % monoammonium phosphate.

Monoammonium phosphate is an example of a flame retardant agent that may used by itself. However, monoammonium phosphate may not provide significant flame resistance if it is not present in a sufficient amount. In an embodiment, the paper product, when dried to a finished level, comprises at least 8 wt. % monoammonium phosphate. As monoammonium phosphate is typically applied dissolved in a solvent, there are limits as to how much monoammonium phosphate can be dissolved before it begins to crystallize and fall out of solution. Additionally, using too much monoammonium phosphate is economically inefficient. In an embodiment, the paper product, when dried to a finished level, comprises less than 24 wt. % monoammonium phosphate. In an embodiment, the paper product, when dried to a finished level, comprises from about 12 to about 20 wt. % monoammonium phosphate. In a particular embodiment, the paper product, when dried to a finished level, comprises about 16 wt. % monoammonium phosphate.

Flame retardant agents may be used in a composition comprising other components as well. By way of example, one composition comprises ammonium sulfate, monoammonium phosphate, urea (as a plasticizer), and alkyl ketene dimer (as a sizing agent to increase water hold-out). In a particular embodiment, the paper substrate is treated to comprise, when dried to a finished level, 13.1 wt. % ammonium sulfate, 5.8 wt. % monoammonium phosphate, 2.4 wt. % urea, and 0.75 wt. % alkyl ketene dimer (AKD) (percentages are percentage by weight).

Tests of Smoothness and Gloss

One of skill in the art will appreciate that the smoothness of a surface of a paper product can be tested in many ways. For example, a standard procedure for this test is described by TAPPI T538, wherein smoothness of a surface on a piece of paper may be measured in units referred to as Sheffield smoothness units (SSU). One Sheffield smoothness unit is equal to 10 SCCM (Standard cubic centimeters per minute). The purpose of such a test is to measure the extent to which the surface of a specimen deviates from a plane, as affected by the depth, width and number of departures from that plane, the measured flow rate of the leakage of air is an indirect measurement of the surface smoothness. This method does not provide absolute smoothness, but rather indicates the degree of smoothness for comparison.

The test comprises using a measuring head, that has concentric annular lands, and is dead-weight loaded against the specimen, which is supported by a flat glass surface. The concentric annular lands have a total area of 97+/−3 $mm^2$ with each land being 0.380+/−mm wide. The outer diameters of the outer and inner lands are 47.07+/−0.03 mm and 34.37+/−0.03 mm respectively. The total mass of the measuring head is 1.60+/−0.005 kg. The glass surface plate is sufficiently flat so that no greater than 1 Sheffield unit of air flow variation is detected as the measuring head is moved over the working area. A regulated air supply is used that is regulated to 10.34+/−0.2 kPa in instruments that utilize variable flowmeters with air bleeds for calibration. In instruments that utilize mass flowmeters with no air bleeds, the supply is regulated to 9.85+/−0.2 kPa. Air pressure is supplied to the zone between the annular rings that form the lands, and the flow rate of air that leaks between the surface of the paper and the metal lands is measured. This process is repeated for at least ten samples of at least 3 inches by 3 inches in size. Commercial instruments are available to measure the smoothness in accordance with this procedure. For example a Technidyne Hagerty division Roughness Tester Model No. 538-S (Technidyne, New Albany, Ind.) can measure smoothness in Sheffield smoothness units in accordance with TAPPI T538.

In an embodiment, the wire-side of the paper substrate contacts the surface of the Yankee cylinder and becomes smoother than the felt-side of the paper substrate. The lower the SSU number the smoother the paper is. If the smooth side of the paper is not smooth to a sufficient degree, it will not be desirable for certain types of end uses. In an embodiment, the smooth side of the paper is less than 200 SSU. Creating paper that is smoother than necessary on one side may reduce the differential smoothness between the two sides. In an embodiment, the smooth side of the paper is greater than 100 SSU. In an embodiment, the smooth side of the paper may have a smoothness in the range from about 100 SSU to about 200 SSU. In a particular embodiment, the smooth side of the paper may have a smoothness of about 150 SSU.

If the less-smooth side of the paper is not smooth to a sufficient degree, it will also not be desirable for certain types of end uses. In an embodiment, the less-smooth side of the paper is less than 330 SSU. Creating paper that is smoother than necessary on one side may reduce the differential smoothness between the two sides. In an embodiment, the less-smooth side of the paper is greater than 150 SSU. In an embodiment, the less-smooth side of the paper may have a smoothness in the range from about 200 SSU to about 280 SSU. In a particular embodiment, the less-smooth side of the paper may have a smoothness of about 240 SSU.

As one side of the paper is smoother than the other, the two sides of one sheet or roll of paper will have different SSU measurements. In an embodiment, the two sides of a paper substrate have a difference of at least 40 SSU in smoothness. The difference may be even greater depending on the desired end uses. In an embodiment, the two sides of a paper substrate have a difference of at least 70 SSU in smoothness. In a particular embodiment, the two sides of paper substrate have a difference of at least 100 SSU in smoothness. In an embodiment, the two sides of a paper substrate have a difference of at least 130 SSU in smoothness.

In an embodiment, the wire-side of the paper substrate contacts the surface of the Yankee cylinder and becomes glossier than the felt-side of the paper substrate. Measurements of gloss can be influenced by the color of the paper. Accordingly, measurements of gloss are most useful for comparing samples of paper that are the same color. One of skill in the art will appreciate that gloss can be measured in a variety of ways. By way of example, gloss can be measured in accordance with TAPPI T480. Instruments are commercially available for measuring gloss such as the Technidyne Glossmeter T480A (Technidyne, New Albany, Ind.).

An exemplary method of testing gloss comprises obtaining at least ten specimens free from folds, wrinkles, or other blemishes. The samples are then illuminated with a light source. The axial ray of the light source is positioned to intersect the specimen at an angle of approximately 75 degrees with respect to a line that is perpendicular to the plane of the specimen. The axial ray of light then specularly reflects off the specimen and passes through a receptor window into a receptor and is measured. The amount of light reflected is converted into gloss units with an ideal, completely reflecting, plane mirror having an assigned value of 384.4 gloss units. Two measurements of each specimen are taken in both the machine direction (MD) and the cross-direction (CD). The measurements are then averaged.

The greater the gloss number, the glossier the paper. If the glossy side of the paper is not glossy to a sufficient degree, it may not be as desirable for certain types of end uses. In an embodiment, the glossy side of the paper is greater than 6 units. Creating paper that is glossier than necessary for a given end use may be undesirable. In an embodiment, the glossy side of the paper is less than 11 units. In an embodiment, the glossy side of the paper may have a gloss in the range from about 7.4 to about 9.8 units. In a particular embodiment, the glossy side of the paper may have a gloss of about 9 units.

If the less-glossy side of the paper is not glossy to a sufficient degree, it may not be as desirable for certain types of end uses. In an embodiment, the less-glossy side of the paper is greater than 3 units. Creating paper that is glossier than necessary for a given end use may be undesirable. In an embodiment, the less-glossy side of the paper is less than 8 units. In an embodiment, the less-glossy side of the paper may have a gloss in the range from about 4.6 to about 6.8 units. In a particular embodiment, the less-glossy side of the paper may have a gloss of about 6 units.

As one side of the paper is glossier than the other, the two sides of one sheet or roll of paper will have different gloss unit measurements. In an embodiment, the two sides of a paper substrate have a difference of at least 2 gloss units. The difference may be even greater depending on the desired end uses. In an embodiment, the two sides of a paper substrate have a difference of at least 3 gloss units.

The above specification provides a complete description of the manufacture and use of the composition of the invention. Since many embodiments of the invention can be made without departing from the spirit and scope of the invention, the invention resides in the claims hereinafter appended.

I claim:

1. A single-ply paper product comprising:

a machine-glazed paper substrate comprising a web of fibers and a sufficient amount of a flame retardant composition to provide the paper substrate with a flame resistance allowing a char length of less than 4.5 inches according to TAPPI T461;

the paper substrate comprising a first surface and a second surface and having a differential smoothness between the first surface and the second surface of at least about 70 SSU according to TAPPI T538, wherein the differential smoothness results from application of the paper substrate to a machine to impart machine-glazed properties to the first surface so that the first surface has a smoothness greater than 100 SSU according to TAPPI T538 and is smoother than the second surface, and wherein the flame retardant composition is applied to the second surface and not to the first surface after application of the paper substrate to the machine to impart machine-glazed properties.

2. A single-ply paper product according to claim 1, wherein the differential smoothness between the first surface and the second surface is at least 100 SSU according to TAPPI T538.

3. A single-ply paper product according to claim 1, wherein the first surface and the second surface have a differential gloss of at least 2 gloss units according to TAPPI T480.

4. A single-ply paper product according to claim 1, wherein the first surface and the second surface have a differential gloss of at least 3 gloss units according to TAPPI T480.

5. A single-ply paper product according to claim 1, wherein the web of fibers comprises at least 10% post-consumer waste fiber.

6. A single-ply paper product according to claim 1, wherein the web of fibers comprises at least 20% post-consumer waste fiber.

7. A single-ply paper product according to claim 1, wherein the web of fibers comprises at least 30% post-consumer waste fiber.

8. A single-ply paper product according to claim 1, wherein the web of fibers comprises cellulose fiber from chemical pulped wood comprising at least one of coniferous and deciduous trees.

9. A single-ply paper product according to claim 1, wherein the web of fibers comprises cellulose fiber from chemical pulped wood comprising at least one of hardwood and softwood.

10. A single-ply paper product according to claim 1, wherein the web of fibers comprises bleached cellulose fiber.

11. A single-ply paper product according to claim 1, wherein the flame retardant composition comprises at least one of ammonium sulfate, monoammonium phosphate, and diammonium phosphate.

12. A single-ply paper product according to claim 11, wherein the flame retardant composition comprises ammonium sulfate and monoammonium phosphate.

13. A single-ply paper product according to claim 12, comprising between 12 and 14 wt. % ammonium sulfate and between 5 and 7 wt. % monoammonium phosphate.

14. A single-ply paper product according to claim 1, wherein the web of fibers has a weight of between 40 lbs./3,000 ft.$^2$ and 54 lbs./3,000 ft.$^2$.

15. A single-ply paper product according to claim 14, wherein the web of fibers has a weight of between 44 lbs./3,000 ft.$^2$ and 50 lbs./3,000 ft.$^2$.

16. A single-ply paper product according to claim 1, wherein the machine to impart machine-glazed properties comprises a drying cylinder having a smoothness-imparting surface.

17. A paper product according to claim 16, wherein the paper product resists flame according to TAPPI test T461.

18. A paper product according to claim 16, wherein the paper product has a char length of less than 5.5 inches according to TAPPI test T461.

19. A single-ply paper product according to claim 1, wherein the first surface has a smoothness greater than 100 SSU to about 200 SSU according to TAPPI T538.

20. A single-ply paper product according to claim 1, wherein the second surface has a smoothness greater than 150 SSU according to TAPPI T538.

21. A single-ply paper product according to claim 1, wherein the second surface has a smoothness of about 200 SSU to about 280 SSU according to TAPPI T538.

22. A paper product comprising:

a machine-glazed paper substrate having a first surface and a second surface and comprising:

a web of fibers; and a flame retardant composition;

wherein the first surface and the second surface have a differential smoothness of at least about 70 SSU according to TAPPI T538 wherein the differential smoothness results from application of the paper substrate to a machine to impart machine-glazed properties to the first surface so that the first surface has a smoothness greater than 100 SSU according to TAPPI T538 and is smoother than the second surface, and wherein the flame retardant composition is applied to the second surface of the paper substrate and not to the first surface after application of the paper substrate to the machine to impart machine-glazed properties.

23. A paper product according to claim 22, wherein the first surface and the second surface have a differential smoothness of at least 100 SSU according to TAPPI T538.

24. A paper product according to claim 22, wherein the first surface and the second surface have a differential gloss of at least 2 gloss units according to TAPPI T480.

25. A paper product according to claim 22, wherein the first surface and the second surface have a differential gloss of at least 3 gloss units according to TAPPI T480.

26. A paper product according to claim 22, wherein the web of fibers comprises at least 10% post-consumer waste fiber.

27. A paper product according to claim 22, wherein the web of fibers comprises at least 20% post-consumer waste fiber.

28. A paper product according to claim 22, wherein the web of fibers comprises at least 30% post-consumer waste fiber.

29. A paper product according to claim 22, wherein the web of fibers comprises cellulose fiber from chemical pulped wood comprising at least one of coniferous and deciduous trees.

30. A paper product according to claim 22, wherein the web of fibers comprises cellulose fiber from chemical pulped wood comprising at least one of hardwood and softwood.

31. A paper product according to claim 22, wherein the web of fibers comprises bleached cellulose fiber.

32. A paper product according to claim 22, wherein the flame retardant composition comprises at least one of ammonium sulfate, monoammonium phosphate, and diammonium phosphate.

33. A paper product according to claim 32, wherein the flame retardant composition comprises ammonium sulfate and monoammonium phosphate.

34. A paper product according to claim 33, comprising between 12 and 14 wt. % ammonium sulfate and between 5 and 7 wt. % monoammonium phosphate.

35. A paper product according to claim 22, wherein the web of fibers has a weight of between 40 lbs./3,000 ft.$^2$ and 54 lbs./3,000 ft.$^2$.

36. A paper product according to claim 22, wherein the web of fibers has a weight of between 44 lbs./3,000 ft.$^2$ and 50 lbs./3,000 ft.$^2$.

37. A paper product according to claim 22, wherein the machine to impart machine-glazed properties comprises a drying cylinder having a smoothness-imparting surface.

38. A paper product according to claim 22, wherein the first surface has a smoothness greater than 100 SSU to about 200 SSU according to TAPPI T538.

39. A paper product according to claim 22, wherein the second surface has a smoothness greater than 150 SSU according to TAPPI T538.

40. A paper product according to claim 22, wherein the second surface has a smoothness of about 200 SSU to about 280 SSU according to TAPPI T538.

* * * * *